US006727005B2

(12) United States Patent
Gimondo et al.

(10) Patent No.: US 6,727,005 B2
(45) Date of Patent: Apr. 27, 2004

(54) PROCESS FOR THE MANUFACTURE OF LOW-DENSITY COMPONENTS, HAVING A POLYMER OR METAL MATRIX SUBSTRATE AND CERAMICS AND/OR METAL-CERAMICS COATING AND LOW DENSITY COMPONENTS OF HIGH SURFACE STRENGTH THUS OBTAINED

(75) Inventors: Pietro Gimondo, Rome (IT); Carlo Costa, Rome (IT)

(73) Assignee: Centro Sviluppo Materiali S.p.A., Rome (IT)

( * ) Notice: Subject to any disclaimer, the term of this patent is extended or adjusted under 35 U.S.C. 154(b) by 0 days.

(21) Appl. No.: 10/168,175

(22) PCT Filed: Dec. 20, 2000

(86) PCT No.: PCT/IT00/00539

§ 371 (c)(1),
(2), (4) Date: Oct. 22, 2002

(87) PCT Pub. No.: WO01/46487

PCT Pub. Date: Jun. 28, 2001

(65) Prior Publication Data

US 2003/0108679 A1 Jun. 12, 2003

(30) Foreign Application Priority Data

Dec. 20, 1999 (IT) ..... RM99A0769

(51) Int. Cl.[7] ..... B05D 1/02; B32B 9/00

(52) U.S. Cl. ..... 428/544; 427/451; 427/452; 427/453; 427/455; 427/456; 427/290; 427/292; 427/316; 427/318; 427/319; 427/327; 427/328; 427/331; 427/355; 427/422; 427/427; 427/450; 428/411.1; 428/457; 428/688; 428/689; 428/704

(58) Field of Search ..... 427/450, 451, 427/452, 453, 455, 456, 290, 292, 316, 318, 319, 327, 328, 331, 355, 422, 427; 428/544, 411.1, 457, 688, 689, 704

(56) References Cited

U.S. PATENT DOCUMENTS

| | | | | |
|---|---|---|---|---|
| 4,388,373 A | * | 6/1983 | Longo et al. | 428/413 |
| 4,617,197 A | * | 10/1986 | Rittner et al. | 427/456 |
| 5,028,477 A | | 7/1991 | McCullough, Jr. et al. | |
| 5,521,015 A | | 5/1996 | Murphy | |
| 5,830,586 A | | 11/1998 | Gray et al. | |

FOREIGN PATENT DOCUMENTS

DE 3527912 A1 2/1987

(List continued on next page.)

OTHER PUBLICATIONS

Thermal Spraying: Practice, Theory, and Application, American Welding Society, 1985, pp. 94–95.*

(List continued on next page.)

*Primary Examiner*—Katherine A Bareford
(74) *Attorney, Agent, or Firm*—Browdy and Neimark

(57) ABSTRACT

Manufacturing low density components of high surface strength having a polymer or metal matrix substrate and ceramics and/or metal-ceramics coating, wherein the low density substrate to be coated is subjected to: optionally, machining the surface in order to generate residual compressive stress in the outer layers; optionally, thermal stabilizing at a temperature lower than 350° C.; depositing onto the outer surface, with hot spraying techniques at a temperature ranging from 70 to 350° C., of a coating layer in ceramics and/or metal-ceramics material of a surface strength higher than that of the component to be coated, the surface of the coating layer being optionally subjected to a finishing treatment. The disclosure also relates to the product thus obtained.

11 Claims, 1 Drawing Sheet

FOREIGN PATENT DOCUMENTS

Figure 1:
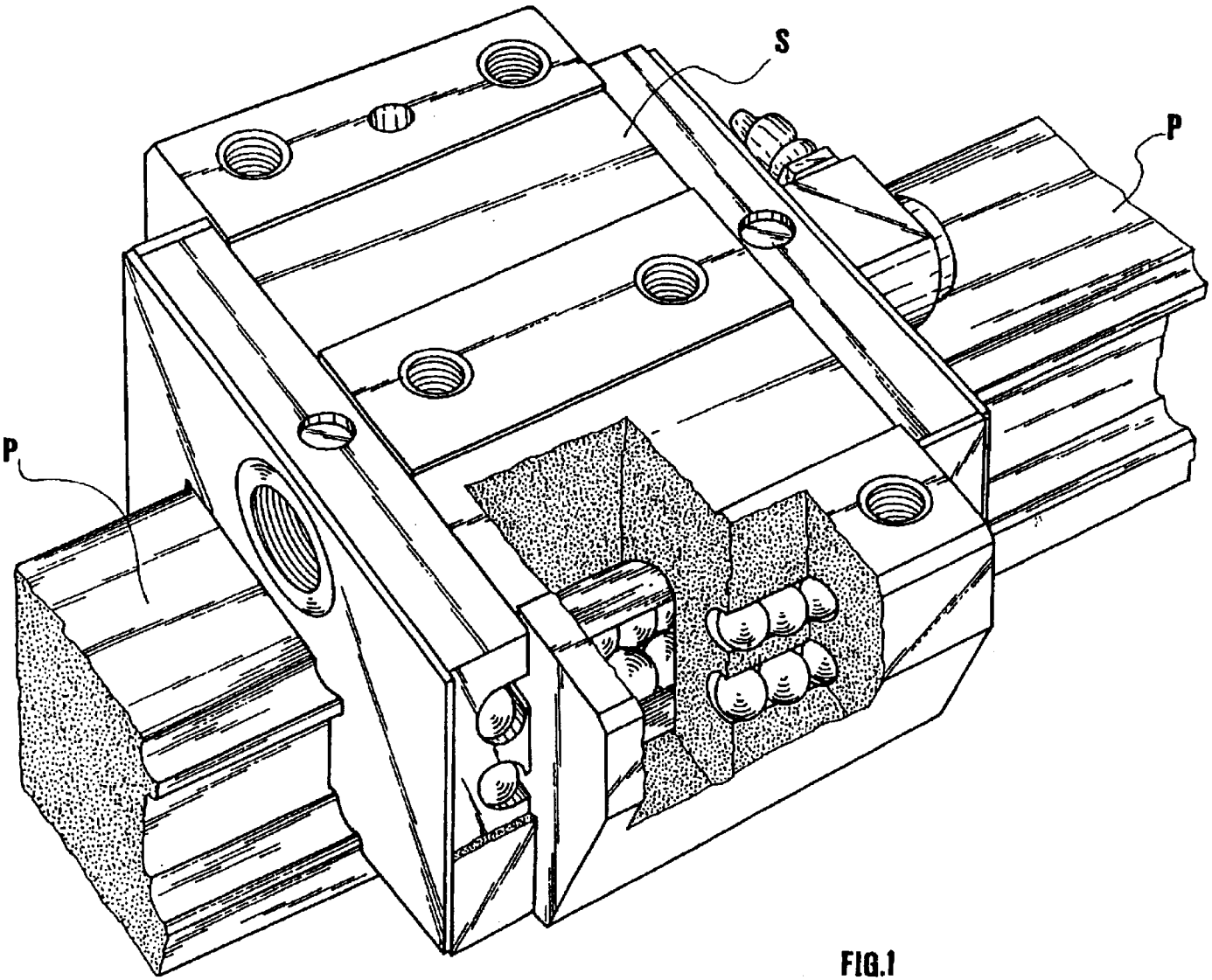

| | | | | |
|---|---|---|---|---|
| DE | 3825200 | C1 | | 2/1990 |
| EP | 0 164 617 | A1 | | 12/1985 |
| FR | 2 630 458 | A | | 10/1989 |
| JP | 59-199725 | | * | 11/1984 |
| WO | WO 96/29443 | | | 9/1996 |
| WO | WO 97/07254 | | | 2/1997 |

OTHER PUBLICATIONS

Database WPI Section Ch Week 199825 Derwent Publications Ltd London UK May 14, 1998 Abstract of WO 9820181.

Database WPI Section Ch Week 199640. Derwent Publications Ltd. London UK Dec. 27, 1995 Abstract of RU 2051199.

* cited by examiner

PROCESS FOR THE MANUFACTURE OF LOW-DENSITY COMPONENTS, HAVING A POLYMER OR METAL MATRIX SUBSTRATE AND CERAMICS AND/OR METAL-CERAMICS COATING AND LOW DENSITY COMPONENTS OF HIGH SURFACE STRENGTH THUS OBTAINED

The present application is the U.S. national phase of PCT application PCT/IT00/00539, filed Dec. 20, 2000.

DESCRIPTION

The present invention relates to a process for the manufacture of low-density components, having a polymer or metal matrix substrate, ennobled with a ceramics and/or metal-ceramics coating, capable of improving the performances of the components in all the situations requiring high surface strength. The process of the invention allows the application on said substrates of protective hard coatings, like, e.g., the carbide-, boride-, nitride-based ceramic ones, capable of remarkably improving the surface strength of the underlying low-density structural material.

As it is known, for application in the industrial, aeronautical and space fields there subsists a need for the availability of compounds capable of competing with the high performances of the steels, yet exhibiting lower specific weight.

EP-A-0,164,617, DE 35 27 912 A, U.S. Pat. No. 5,521,015 disclose process of hot spraying deposition of a coating having a strength greater than that of the respective low density substrate.

The present invention allows to comply with the above-mentioned need, further providing other advantages that will hereinafter be highlighted.

In fact, the present invention relates to a process for the manufacture of low density components, having a polymer or metal matrix substrate, and ceramics and/or metal-ceramics coating, in which the low density substrate to be coated is subjected to the following steps:

- machining the surface in order to generate residual compressive stress in the outer layers;
- thermal stabilising at a temperature lower 350° C.;
- depositing onto the outer surface, with hot spraying techniques at a temperature ranging from 70° to 350° C., of a coating layer in a ceramics and/or metal-ceramics material with a surface strength higher than that of the component to be coated; and
- finishing the surface of the coating layer by a finishing treatment.

The surface machining, in order to generate residual compressive stress in the outer layers of the component to be coated consists of a treatment selected from the group consisting of peening and/or sandblasting and/or combinations thereof.

The finishing treatment of the surface of the coating layer comprises of a machining selected from the group consisting of grinding, polishing, tumbling, rumbling and combinations thereof.

The hot spraying techniques are selected from the group comprising high velocity hot spraying (HVOF, High Velocity Oxy-Fuel), plasma spraying (VPS-Vacuum Plasma Spraying, CAPS-Controlled Atmosphere Plasma Spraying, APS, HPPS), Flame Spraying (FS), Plasma Transferred Arc (PTA), Arc Spraying (AS), and combinations thereof.

The hot sprayed coating layer has a thickness comprised in the range from 100 to 4200 $\mu$m, preferably from 100 to 500 $\mu$m.

The coating layer is selected from the group consisting of WC-M, CrC-M, TiC-M, BN-M, SiC-M, wherein M is the metal matrix selected from the group consisting of Ni, Co, NiCr, NiCrFeBSi, NiCrCuMoWB.

It has been observed that satisfactory results are obtained in the present invention adopting low density materials exhibiting an E/p (Modulus of elasticity/specific weight) value of the same order of that of the reference 17-4PH steel (E/p=25 GPa/kg/dm$^3$).

Accordingly, light metals, like aluminium and titanium, Ti/Al alloys, metal matrix composites thereof and polymer matrix composites (usually made of fibres immersed in a polymer matrix) were found to be suitable for use as substrates in the present invention.

Concerning the metal matrix composites, satisfactory results were obtained with compounds made of an aluminium matrix charged with a charge percent of about 10–20% titanium carbide (yielding higher E and coefficient of thermal expansion $\alpha$ with respect to the pure aluminium) and a composite made of titanium charged with 10–20% titanium carbide. The E/p ratio for these composites is 28.6 and 28.2 GPa/kg/dm$^3$, respectively. In order to compare the characteristics of these materials, it has to be pointed out that the AA7075 aluminium alloy and the T6Al4V titanium alloy exhibit E/p values of 26.7 and 24.2, respectively (see also the comparison reported in Table 1).

TABLE 1

| | E (GPa) | $\alpha$ (° C. − 1) | $\rho$ (kg/dm$^3$) | E/p (GPa/kg/dm$^3$) |
|---|---|---|---|---|
| A1 (AA7075) | 72 | 18 × 10 − 6 | 2.7 | 26.7 |
| A1 + 10% TiC | 80 | 15 × 10 − 6 | 2.8 | 28.6 |
| Ti6A14V | 110 | 8 × 10 − 6 | 4.54 | 24.2 |
| Ti + 10% TiC | 130 | 7.6 × 10 − 6 | 4.6 | 28.2 |

Concerning the composite materials, their properties depend on the matrix and fibrefill selection.

In this respect, carbon fibres which have moduli of elasticity ranging from 160 (low modulus) to 725 (very high modulus) are of special interest. Highly promising are, e.g., the carbon-carbon, composites made of carbon fibres in a carbon matrix, having a modulus of elasticity ranging from 125 to 220 GPa. These materials have an 1.3–1.6 kg/dm$^3$ density, thereby yielding $\geqq$78 (GPa/kg/dm$^3$) E/p values.

Other highly promising fibrefill are the boron fibres, having a modulus of elasticity of about 400 GPa, though being accordingly more expensive, with respect, e.g., to the carbon fibres (approximately 2-fold with respect to a High Modulus).

Another crucial aspect that needs considering re the fibrefill concerns the glass fibres, having moduli of elasticity ranging from 69 to 86 GPa with 2.4–2.6 kg/dm$^3$ densities, and hence seemingly not useful in several industrial, aeronautical and space fields.

The selection of the composite material matrix deserves a much ampler account. In this respect, it has to be pointed out that satisfactory results were attained with the polyetheretherketone, commercially known as PEEK, and with an epoxy resin.

The characteristics of these two resins are reported in Table 2 and in Table 3, respectively.

TABLE 2

| Polyetheretherketone polymer (TECAPEEK) specifications | |
|---|---|
| Generic name: | PEEK |
| Polymer type: | Non-reinforced granules |
| Fillers, lubricants and other (%): | — |
| Manufacturing process: | Extrusion |
| Applicable Standard (ASTM, MIL . . . ): | DIN: PEEK |

TABLE 2-continued

| Polyetheretherketone polymer (TECAPEEK) specifications | |
|---|---|
| Trademark and Number: | TECAPEEK |
| Orientation of wear surfaces on the original shape: | Perpendicular sections of the rod |
| Lubricants onto the surface or in the material: | — |
| Heat treatments adopted: | |
| Specifications | 1.32 g/cm$^3$ |
| Density: | |
| Coefficient of thermal expansion (CTE): | 4.7 ($10^{-3}K^{-1}$) |
| Ultimate strength (U.T.S.): | 92 MPa |
| Elongation (%): | 50% |
| Young's Modulus (E): | 3.6 GPa |
| Compressive strength: | 118 MPa |
| Young's Modulus under bending: | 4.1 GPa |
| Strength to bending stress: | 170 MPa |
| Poisson's ratio | — |
| Izod impact resistance: | 65 I/m |
| Rockwell hardness (R scale): | R126 |
| Bending fatigue limit: | — |
| Melting temperature (Tm): | 334° C. |
| Glass transition temperature (Tg): | 143° C. |
| Loaded deflection temperature 1.82 MPa: | 140° C. |
| Continuous operation temperature limit: | 250° C. |
| Transitory operation temperature limit: | 300° C. |

TABLE 3 epoxy resin specifications
PROPERTIES:
LIQUID POLYMER:

| PROPERTIES | NOTES | VALUE |
|---|---|---|
| Appearance | | Clear |
| Density | at 25° C. | 1.14 g/cc |
| Viscosity (Brookfield) | at 30° C. | 180 cP |
| | at 35° C. | 125 cP |
| Penetration depth | | 4.8 mils |
| Critical exposure | | 13.5 ml/cm$^2$ |

CROSS-LINKED POLYMER:

| PROPERTIES | METHOD | VALUE |
|---|---|---|
| Modulus of elasticity | DIN 53455 | 2600–2800 MPa |
| Elongation at break | DIN 53455 | 6–11% |
| Impact resistance* | DIN 52453/iso r 179 | 25–35 kJ/m$^2$ |
| Impact resistance** | DIN 52453/ISO R 179 | 13–15 kJ/m$^2$ |
| Hardness | DIN 53505 | 85 (Shore D) |
| Glass transition temperature | DMA, 4° C./minute | 65–90° C. |

*Tests cast between glass plates and UV post-crosslinked for 30 minutes in PCA-250.
**Tests carried out with SLA (WEAVE) and UV post-crosslinked for 30 minutes in PCA-250.

In the case of polymer matrix composite materials, the most promising hot spraying coating techniques are the Plasma Spraying (PS) and the High Velocity Oxy-Fuel (HVOF), as these exhibit a low thermomechanical load with respect to other hot spraying technologies. Concerning instead the metal matrix composites to be coated, the spraying technologies have a quite small thermomechanical impact thereon.

The invention is not limited to the process for the manufacture, also extending to the low-density, high surface strength, coated components thus obtained.

So far, a general description of the present invention has been provided. With the aid of the single annexed FIGURE (FIG. 1) and of the examples hereinafter a more detailed description of specific embodiments, aimed at making better understood the objects, the features, the advantages and the operation modes thereof, will be provided.

FIG. 1 is a perspective view of a recirculating ball unit, made of a raceway P, coated with an embodiment of the process according to the present invention, and a ball slide S.

EXAMPLE 1

Manufacture of Raceways for Recirculating Ball Unit Coated With the Process According to the Invention The component to be coated is a raceway for recirculating ball unit, manufactured with a composite material having an aluminium metal matrix comprising 15% titanium carbide.

The surface of this component was roughened by sandblasting and the resulting product was set on a rotary table to be coated with the HVOF hot spraying technique.

The material pre-selected for coating is a metal-ceramics composite having the following % by weight composition: metal-ceramics having the following % by weight composition: 14.1 WC 75-Ni; 5 Cr; 1 Cu; 2 W; 2.2 Mo; 0.2 B. This material is characterised by an excellent resistance to wear, erosion and corrosion.

After having turned on the flame of a HVOF-type hot spraying apparatus, the flame parameters are adjusted to values suitable to obtain homogeneous coatings, with low porosity value and free of cast-in (embedded) particles, oxides and cracks. The torch is positioned at a 180-mm distance, with the component to be coated revolving at a 60 rpm speed, and is shifted along the longitudinal axis at a speed of about 200 mm/s for a height of about 150 mm. During this coating step the temperature ranges from 50 to 150° C. Post-spraying, the component was slowly cooled in still air. Then, the component surface was machined by grinding with a mesh 20 SiC grinding wheel, until having removed the surface roughness. The final thickness of the ground coating was of about 400 $\mu$m.

The coating thus obtained is wear-resistant, and the thickness thereof is suitable for absorbing the load stresses of the balls and the tilting moments about all the axes.

As it is known, such stresses usually are of at least 1000 MPa, climbing even to 3500 MPa for specific uses, which foresee high speeds and elevated accelerations.

FIG. 1 is a perspective view of the recirculating ball unit, the raceway P, with a substrate made in Al—TiC 15% composite coated as set forth above and the ball slide S being highlighted therein.

EXAMPLE 2

Manufacture of Drill Rods (AP) Coated with the Process According to the Invention A drill rod (AP), manufactured in epoxy resin comprising carbon fibres (fibre direction ±10° with respect to the pipe axis), was subjected to the coating process according to the invention.

The surface of the drill rod was roughened by thermal sandblasting and the resulting product was set on a rotary table to be coated with the HVOF hot spraying technique.

The pre-selected material is a metal-ceramics composite having the following % by weight composition: 14.1 WC 75-Ni; 5 Cr; 1 Cu; 2 W; 3.2 M0; 0.2 B. This material is characterised by an excellent surface strength to wear, corrosion and erosion.

After having turned on the flame of an HVOF-type hot spraying apparatus, the flame parameters are adjusted to values suitable to obtain homogeneous coatings, with low porosity value and free of cast-in (embedded) particles, oxides and cracks. A torch is positioned at a 380-mm distance, with the component to be coated revolving at a 60 rpm speed, and is shifted along the longitudinal axis at a speed of about 200 mm/s for a height of about 150 mm. During this coating step the temperature ranges from 50 to 150° C.

Post-spraying, the coated drill rod was slowly cooled in still air. Then, the surface of the component was machined by grinding with a mesh 20 SiC grinding wheel, until having removed the surface roughness.

The final thickness of the ground coating was of about 450 $\mu$m.

The drill rod thus coated endures, high operative loads, concomitantly ensuring an improved strength to slurry erosion.

What is claimed is:

1. A process for the manufacture of low density components of high surface strength, having a polymer or metal matrix substrate and ceramics and/or metal-ceramics coating, wherein the low density substrate to be coated is subjected to:

machining the surface in order to generate residual compressive stress in the outer layers of the substrate;

thermal stabilizing at a temperature lower than 350° C.;

depositing onto and entirely over the outer surface of the substrate, with a hot spraying technique at a temperature ranging from 70° to 350° C., a coating layer of a ceramics or metal-ceramics material with a surface strength higher than that of the substrate to be coated; and finishing the surface of the coating layer by a finishing treatment.

2. The process for the manufacture of low density components of high surface strength, having a polymer or metal matrix substrate and a ceramics and/or metal-ceramics coating according to claim 1, wherein the machining of the surface in order to generate residual compressive stress in the outer layers of the substrate to be coated comprises a treatment selected from the group consisting of peening, sandblasting and combinations thereof.

3. The process for the manufacture of low density components of high surface strength, having a polymer or metal matrix substrate and ceramics and/or metal-ceramics coating, according to claim 1 or 2, wherein the finishing treatment of the surface of the coating comprises of a machining selected from the group consisting of grinding, polishing, tumbling, rumbling and combinations thereof.

4. The process for the manufacture of low density components of high surface strength, having a polymer or metal matrix substrate and ceramics and/or metal-ceramics coating according to claim 3, wherein the hot spraying technique is selected from the group consisting of high velocity hot spraying High velocity Oxy-Fuel, Vacuum Plasma Spraying, Controlled Atmosphere Plasma Spraying, Atmospheric Plasma Spraying, High Pressure Plasma Spraying, Flame Spraying, Plasma Transferred Arc, Arc Spraying, and combinations thereof.

5. Process for the manufacture of low density components of high surface strength, having a polymer or metal matrix substrate and ceramics and/or metal-ceramics coating, according to claim 1 or 2, wherein the coating layer is selected from the group consisting of WC—M, CrC—M, TiC—M, BN—M, and SiC—M, wherein M is the metal matrix selected from the group consisting of Ni, Co, NiCr, NiCrFeBSi, and NiCrCu-MoWB.

6. A low density coated component of high surface strength, obtained by the process according to claim 1 or 2.

7. A process for the manufacture of low density components of high surface strength, having a polymer or metal matrix substrate and ceramics and/or metal-ceramics coating, wherein the low density substrate to be coated is subjected to:

machining the surface in order to generate residual compressive stress in the outer layers;

thermal stabilizing at a temperature lower than 350° C.;

depositing onto the outer surface of the substrate, with a hot spraying technique at a temperature ranging from 70° to 350° C., of a coating layer in a ceramics or metal-ceramics material with a surface strength higher than that of the component to be coated; and finishing the surface of the coating layer by a finishing treatment;

wherein the hot spraying technique is selected from the group consisting of high velocity hot spraying High velocity Oxy-Fuel, Vacuum Plasma Spraying, Controlled Atmosphere Plasma Spraying, Atmospheric Plasma Spraying, High Pressure Plasma Spraying, Flame Spraying, Plasma Transferred Arc, Arc Spraying, and combinations thereof.

8. The process for the manufacture of low density components of high surface strength, having a polymer or metal matrix substrate and ceramics and/or metal-ceramics coating according to claim 7, wherein the hot sprayed coating layer has a thickness in the range from 100 to 500 $\mu$m.

9. Process for the manufacture of low density components of high surface strength, having a polymer or metal matrix substrate and ceramics and/or metal-ceramics coating, according to claim 8, wherein the coating layer is selected from the group consisting of WC-M, CrC-M, TiC-M, BN-M, and SiC-M, wherein M is the metal matrix selected from the group consisting of Ni, Co, NiCr, NiCrFeBSi, and NiCrCu-MoWB.

10. A low density coated component of high surface strength, obtained by the process according to claim 9.

11. A process for the manufacture of low density components of high surface strength, having a polymer or metal matrix substrate and ceramics and/or metal-ceramics coating, wherein the low density substrate to be coated is subjected to:

machining the surface in order to generate residual compressive stress in the outer layers;

thermal stabilizing at a temperature lower than 350° C.;

depositing onto the outer surface of the substrate, with a hot spraying technique at a temperature ranging from 70° to 350° C., of a coating layer in a ceramics or metal-ceramics material with a surface strength higher than that of the component to be coated; and finishing the surface of the coating layer by a finishing treatment;

wherein the hot sprayed coating layer has a thickness in the range from 100 to 4200 $\mu$m.

* * * * *